United States Patent [19]

Hennemann

[11] Patent Number: 5,062,024

[45] Date of Patent: Oct. 29, 1991

[54] MODULAR CONNECTOR FOR PRINTED CIRCUIT BOARDS

[75] Inventor: Lothar R. Hennemann, Minden, Fed. Rep. of Germany

[73] Assignee: WAGO Verwaltungsgesellschaft mbH, Minden, Fed. Rep. of Germany

[21] Appl. No.: 502,064

[22] Filed: Mar. 29, 1990

[30] Foreign Application Priority Data

Apr. 1, 1989 [DE] Fed. Rep. of Germany ..... 3910937

[51] Int. Cl.[5] ..... H01R 9/00

[52] U.S. Cl. ..... 361/426; 439/329; 439/717

[58] Field of Search ..... 174/267; 317/101; 361/396, 403, 404, 405, 406, 408, 412, 413, 417, 419, 420, 426, 74, 65; 439/258, 76, 259, 260, 261, 262, 264, 265, 268, 269, 270, 284, , 285, 286, 288, 291, 78, 77, 80, 329, 571, 572

[56] References Cited

FOREIGN PATENT DOCUMENTS 1924219 1/1970 Fed. Rep. of Germany ..... 439/329

*Primary Examiner*—Leo P. Picard
*Assistant Examiner*—Donald A. Sparks
*Attorney, Agent, or Firm*—Salter & Michaelson

[57] ABSTRACT

This invention proceeds from the type of stackable connectors for printed circuit boards, and it addresses the problem of being able to fasten such terminals in pricise and stable position to a printed circuit board, so that the solder connections of the terminals can be soldered to the conductive tracks with no problems. It is suggested to provide such connectors with a narrow-base catch peg that is located next to the solder connection of the terminal in the direction of stacking, with the width dimension measured across the solder connection and the narrow-base catch peg being equal to or smaller than the grid spacing of the conductive tracks of the printed circuit board.

3 Claims, 2 Drawing Sheets

FIG. 4
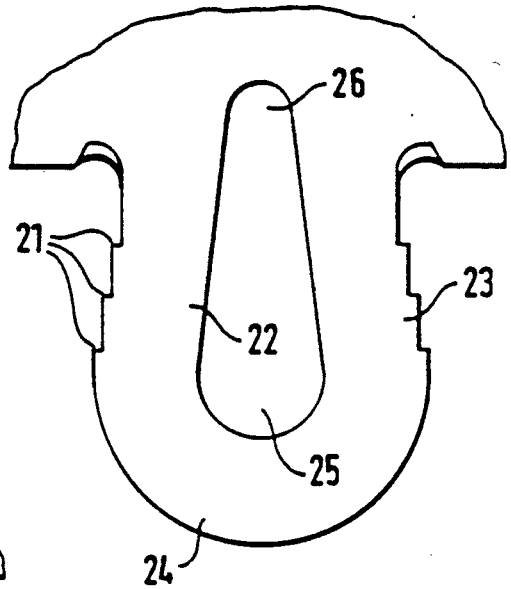
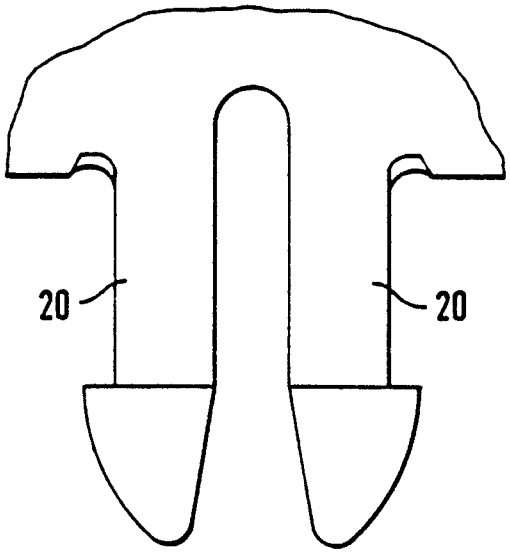
FIG. 3
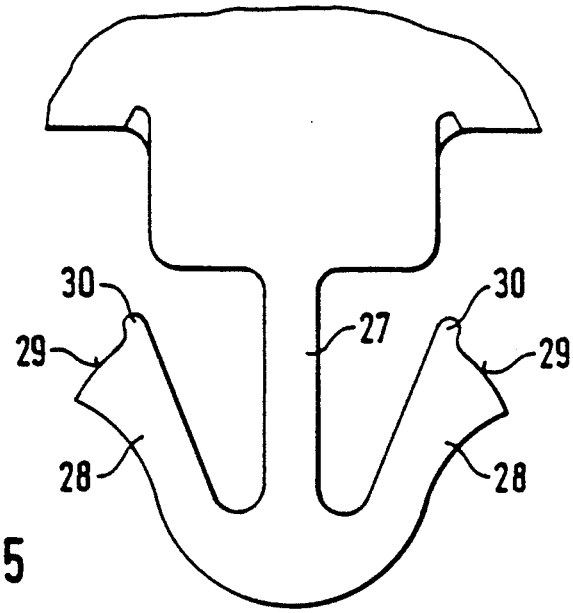
FIG. 5

MODULAR CONNECTOR FOR PRINTED CIRCUIT BOARDS

Stackable connectors for printed circuit boards, printed circuits, or the like are known. They are of single-pin or pole or multiple-pin design and have at least one solder connection for each connector pin, for example in the form of a round soldering pin or a flat soldering lug. This solder connection is soldered to one of the board connector surfaces or conductive tracks of the printed circuit board provided for the purpose after placing and fastening the terminal block to the printed circuit board, so that power or current signals are supplied to the electrical conductor of the particular conductive track of the printed circuit board wired to the terminal block by any connecting technique, or can be tapped from the particular conductive track.

To fasten terminal block to printed circuit boards, it is known how to use screws, rivets, clamping sleeves, insert pins, or the like that are pushed through corresponding fastening openings in the printed circuit board. Of course, such fasteners need space and almost always "use up" the same space as a single-pin connector, i.e., they always also use a conductive track of the printed circuit board just for fastening purposes. For this reason, it is customary to design the known terminal blocks for printed circuit boards as multiple-pin terminal strips or terminal blocks that can be fastened to the printed circuit board as space-saving components that are inherently rigid, for example with only two fastening screws on the ends.

Such a space-saving fastener with only two fastening elements, however, can no longer be made when stackable and preferably single-pin terminal block are involved. These do have the advantage that by connecting individual terminal connectors, any desired multiple-pin terminal block strip can be put together, but such terminal block strips then have the drawback that the terminal strips formed from them are inherently relatively fragile, so that for example fastening elements provided only at the ends are usually inadequate for fastening all of the terminal block of such a terminal strip with all of their solder connectors with sufficient accuracy and stability of position on a printed circuit board, so that the subsequent soldering of the solder connections to the particular conductive tracks can be carried out as automatically as possible.

Two processes that can be carried out automatically to a great extent are common in practice for soldering the solder connections to the particular conductive tracks of the printed circuit board. In the one case, soldering pins are used as solder connections for the terminals which are pushed through corresponding holes in the printed circuit board when the terminals are placed and fastened on the printed circuit board, and are usually soldered to the associated conductive tracks on the back of the printed circuit board. In the other case, soldering lugs are used as solder connections for the terminals, which are only laid loosely from above on the surface of the conductive tracks when the connectors are placed on the printed circuit boards, and are then soldered to the conductive tracks in a subsequent soldering process (SMD technique, i.e., surface mounted device). In particular, however, in the SMD technique it is absolutely necessary for the solder connections to be kept in precise and stable position on the printed circuit board until the subsequent soldering process is complete, and each individual connector is then also held by its soldered connection.

This invention proceeds from the type of terminal block strips for printed circuit boards and it addresses the problem of being able to fasten and hold on a printed circuit board a terminal block strip of modular construction, preferably of single-pin individual terminals, in such a way that all of the requirements of modern printed circuit board connectors are met, specifically

- modular construction with any number of pins and thus adaptable to any desired number of conductive tracks,
- space-saving fastening without "using up" a conductive track,
- precise and stable fastening of the solder connections in position in spite of the modular construction by the space-saving fastening alone,
- especially usable for the SMD technique and for automatic production processes (pick and place).

The method of the invention is characterized by the fact that the fastening element has the design of a catch peg molded on the bottom of the terminal case that engages in a corresponding catch recess in the printed circuit board, with the catch peg having a narrow cross section extending perpendicular to the direction of stacking of the terminals (and because of this characteristic being called a narrow-base catch peg below), and that the narrow-base catch peg is also molded to the terminal case below the connecting pin or pole in such a way that it is located next to the solder connection of the connecting pin or pole in the direction of connecting of the terminals, with the width dimension measured in the direction of connecting of the terminals over the solder connection and the narrow-base catch peg together, being equal to or smaller than the grid spacing of the conductive tracks of the printed circuit board.

The use pursuant to the invention of a narrow-base catch peg that is molded to the bottom of the terminal case displaced laterally next to the solder connection makes it possible to accomplish a latch fastening of the terminal case and also to contact the associated conductive track within the grid spacing of the conductive tracks. A particularly advantageous embodiment of the invention provides that the major cross section of the narrow-base catch peg and the corresponding catch recess in the printed circuit board are of essentially rectangular design.

Such a rectangular recess in the printed circuit board has the advantage over a round hole recess that in spite of adequate dimensions of the narrow-base catch peg, it weakens the strength of the printed circuit board less than a round hole recess of the same area. Added to this is the fact that a rectangular recess, in spite of the adequately large dimensions of the narrow-base catch peg, can be of such dimensions directly that it can be placed between two adjacent conductive tracks of a printed circuit board without intercepting or cutting through the conductive tracks themselves.

It is important to be able to position the connectors pursuant to the invention in a simple assembly process (pick and place) both as individual terminals and as a modular terminal block strip with any desired number of pins on a printed circuit board, and at the same time to be able to fasten them to the printed circuit board permanently and in precise position, so that each solder connection of the connector contacts the conductive track assigned to it with stable position, and accordingly the subsequent soldering process itself can then be executed with no problems, when the solder connection according to the SMD technique initially lies only loosely on the surface of the conductive track.

The narrow-base catch peg can be made in different forms of embodiment two, each of which has an inventive nature by itself. These forms of embodiment are discussed in detail in the following description of the figures.

It must be emphasized that well-designed narrow-base catch pegs produce a substantial holding force in the corresponding catch recess of the printed circuit board, that makes it unnecessary for each individual terminal in multiple-pin terminal strips to be latched to the printed circuit board, but for example, only every second or third individual terminal. This makes it possible to reduce the number of catch recesses in the printed circuit board, so that it is not weakened by unnecessary catch recesses.

DESCRIPTION OF THE DRAWINGS

Examples of embodiment of the invention will be described in detail below with reference to the drawings. The drawings show.

DESCRIPTION OF THE INVENTION

Figure 1:
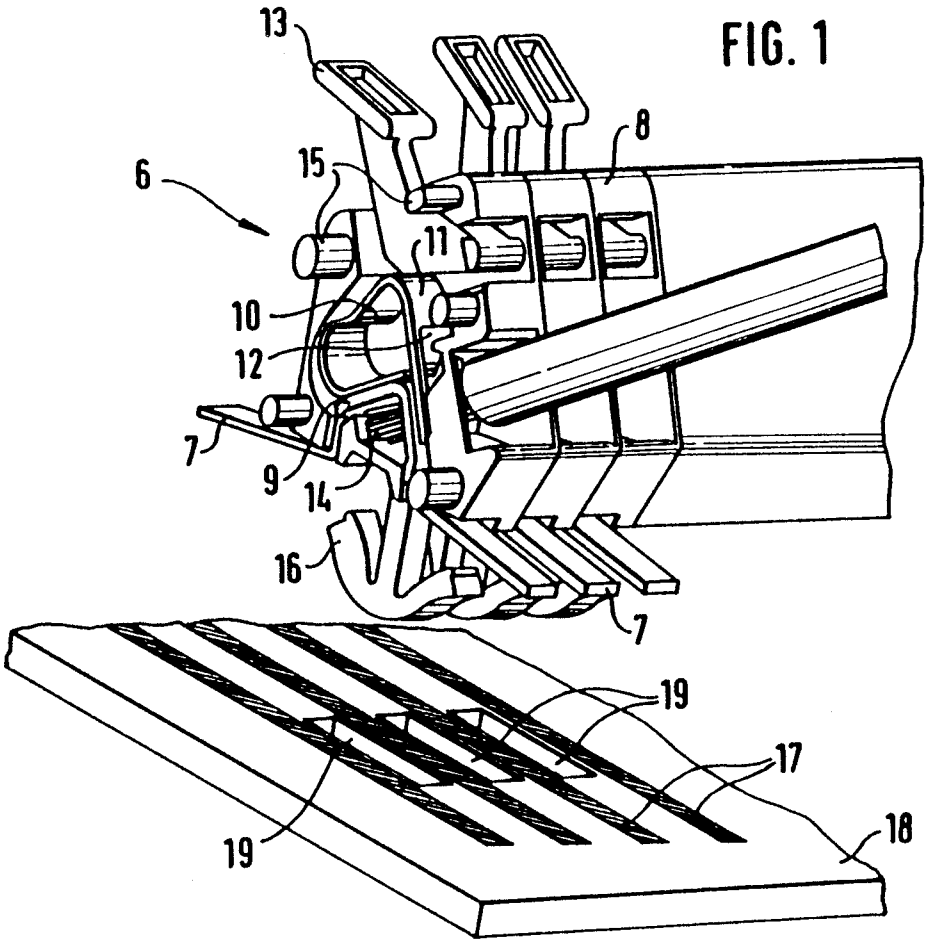
FIG. 1 a modular terminal block strip pursuant to the invention in perspective illustration, FIG. 2 a front view of the terminal block strip of FIG. 1, FIGS. 3–5 different forms of embodiment of narrow-base catch pegs.

The terminal block 6 shown recognizably with its metal inserts in FIG. 1 has two solder connections 7, which extend forward and toward the rear from the bottom of the terminal case 8 and are punched out of a sheet material with good electrical conductivity in one piece with the busbar 9.

The busbar 9 has a cage tension spring 10 in a known way whose upper spring arm 11 can be pressed downward with its cage opening 12, by moving the operating key 13 like a lever downward. This opens the cage opening for the flexible lead wire 14, which it draws against the busbar from below in the unactuated condition.

Figure 2:
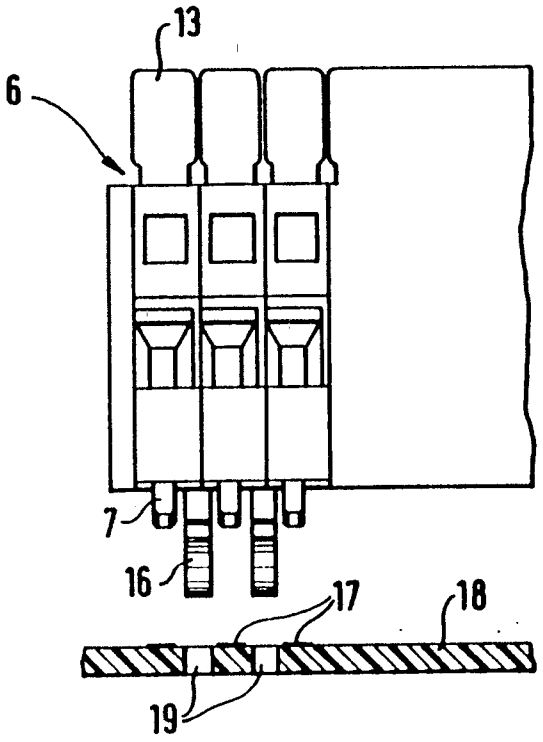

The terminal case 8 as illustrated has a total of 5 connecting pegs 15, so that the connectors can be connected with other connectors of the same type with no problems, as shown in FIGS. 1 and 2.

FIG. 2 shows that a narrow-base catch peg 16 is molded to the terminal case 8 next to the solder connections 7 in the direction of stacking of the terminals. The design and function of this catch peg will be described in further detail below with reference to FIG. 5.

It can also be seen from FIGS. 1 and 2 that the width dimension measured jointly in the direction of stacking of the terminals over the solder connection 7 and the narrow-base catch peg 16 is equal to or smaller than the grid spacing of the conductive tracks 17 of the printed circuit board 18. Since the major cross section of the narrow-base catch peg together with the catch recess 19 in the printed circuit board 18 corresponding to the catch peg at the same time is of rectangular design, with correct dimensioning, the catch recesses 19 are located precisely between the conductive track 17 of the printed circuit board 18 without intersecting the conductive tracks.

FIG. 2 shows that the narrow-base catch peg 16 can also project laterally beyond the contour of the terminal case of the connector when it is desired to locate the solder connection 7 in the center beneath the terminal case. It is only essential for the width dimension measured jointly over the solder connection and the narrow-base catch peg to be equal to or smaller than the grid spacing of the conductive tracks 17.

FIG. 3 shows a side view of a narrow-base catch peg of standard design with two spring arms that engage with a printed circuit board of specific thickness that corresponds to their intended latching.

FIG. 4 shows a side view of a substantially more advantageous embodiment of a new narrow-base catch peg that can likewise be used instead of the catch peg 16 of the connector in FIG. 1. This catch peg illustrated in FIG. 4 can latch with printed circuit boards of different thicknesses. A total of 3 latching positions are illustrated in the form of latch teeth 21. Important features here are that the narrow-base catch peg is formed of two spring side webs 22 and 23 opposite one another, that are connected to one another at their top ends by a top web 24 in the manner of a closed oblong eye. The diameter of the head 25 of the oblong eye is greater than the base diameter 26, so that the backs of the lateral webs pointing outward and provided with the latch teeth 21 increase diagonally outward starting from their base points toward the head web.

Because of the features mentioned above, the lateral webs 22 and 23 can spring together more strongly in the area of the larger head diameter of the oblong eye than in the area of the smaller base diameter of the oblong eye. Because of this, when this narrow-base catch peg is used, the back contour rising diagonally outward is increasingly compensated toward the head web, so that as a result any printed circuit board in spite of its different thickness and in spite of the different latch teeth 21 engaged is gripped with a uniformly large holding force of the narrow-base catch peg in the particular corresponding catch recesses 19 in the printed circuit boards.

The narrow-base catch peg illustrated in side view in FIG. 5, which is also illustrated in FIGS. 1 and 2, again serves for latching only with a printed circuit board of specific thickness. However, it has the advantage that it can compensate for tolerance inaccuracies in the thickness of the particular printed circuit board, so that in spite of these possible tolerance inaccuracies, the connector can be held to the printed circuit board with precise positioning.

In detail, the narrow-base catch peg of FIG. 5 has a central web 27 with two spread wings 28 molded to it with spring elasticity. As soon as these spread wings 28 are pushed through the printed circuit board catch recess 19 (cf. FIG. 1), they spread apart until their front diagonal surfaces 29 come to rest against the front bottoms of the printed circuit board catch recess 19. These diagonal surfaces 29 are designed to rise diagonally relatively to the deflection point of the spread wings 28 on the central web 27, so that when the spread wings 28 are spread out, tolerance inaccuracies in the thickness of the printed circuit board are compensated. The spreading of the wings is completed when their shoulder stops 30 encounter the inner surfaces of the printed circuit board catch recess 19.

I claim:

1. A modular terminal block strip for a printed circuit board, said printed circuit board having a plurality of uniformly spaced substantially parallel conductive tracks of substantially equal width thereon, and having a plurality of spaced recesses formed therein, said recesses extending through said circuit board between said conductive tracks and having widths which are less than or equal to the spacing between their respective adjacent conductive tracks, said terminal block strip comprising a plurality of connected terminal blocks, each of said terminal blocks being adapted to be assembled with said printed circuit board, and each comprising a case, a catch peg integrally formed with the case thereof, and at least one solder connection extending from the case thereof adjacent the catch peg thereof, each of said solder connections being adapted to be soldered to one of said conductive tracks and being received in engagement therewith when the respective terminal block thereof is assembled with said circuit board, each of said catch pegs being received in engagement in one of said recesses which is adjacent to the conductive track engaged by the respective solder connection thereof when said catch pegs are assembled with said circuit board for thereby retaining, said terminal blocks in position on said circuit board.

2. In the terminal block strip of claim 1, the catch peg of at least one of said terminal blocks comprising a base portion extending from said terminal case, a pair of spring webs extending in diverging spaced relation from said base portion, a head web connecting said spring webs at a point which is spaced from said base and at least one latch tooth on each of said spring webs.

3. In the terminal block strip of claim 1, the catch peg of at least one of said terminal blocks comprising a base portion extending from said terminal case, a central web extending from said base portion and a pair of spread wings extending outwardly in opposite directions from said central web and angularly back toward said base portion, said spread wings being resiliently deflectable to compensate for variations in the thickness of said circuit board.

* * * * *